US005584389A

United States Patent [19]

Focke et al.

[11] Patent Number: 5,584,389

[45] Date of Patent: Dec. 17, 1996

[54] PACK FOR STICK-SHAPED ARTICLES, SUCH AS CIGARETTES, AND BLANK FOR PRODUCING THE PACK

[75] Inventors: Heinz Focke, Verden; Thomas Häfker, Etelsen, both of Germany

[73] Assignee: Focke & Co. (GmbH & Co.), Verden, Germany

[21] Appl. No.: 219,720

[22] Filed: Mar. 29, 1994

[30] Foreign Application Priority Data

Mar. 30, 1993 [DE] Germany ..... 43 10 123.2
Apr. 8, 1993 [DE] Germany ..... 43 11 568.3

[51] Int. Cl.[6] ..... B65D 85/10

[52] U.S. Cl. ..... 206/256; 206/265; 206/273

[58] Field of Search ..... 206/256, 265, 206/271, 273; 229/160.1

[56] References Cited

U.S. PATENT DOCUMENTS

| | | | |
|---|---|---|---|
| 1,158,826 | 11/1915 | Mendelson | 206/256 |
| 1,160,930 | 11/1915 | Mendelson | 206/256 |
| 2,617,578 | 11/1952 | Fischer | 206/273 |
| 2,820,545 | 1/1958 | Bramhill | 206/256 |
| 3,159,272 | 12/1964 | Swift | 206/256 |
| 4,444,308 | 4/1984 | MacEwen . | |
| 5,277,304 | 1/1994 | Brizzi et al. | 206/256 |
| 5,325,963 | 7/1994 | Focke et al. | 206/265 |

FOREIGN PATENT DOCUMENTS

| | | |
|---|---|---|
| 330969 | 3/1988 | European Pat. Off. . |
| 330938 | 9/1989 | European Pat. Off. . |
| 712353 | 10/1931 | France . |
| 2597077 | 10/1987 | France . |
| 6939052 | 10/1969 | Germany . |
| 8103619 | 5/1981 | Germany . |

*Primary Examiner*—David T. Fidei
*Attorney, Agent, or Firm*—Sughrue, Mion, Zinn, Macpeak & Seas

[57] ABSTRACT

To improve the possibility of extracting cigarettes from the pack, the bottom wall of the pack is made to be bevelled, that is, oblique, with respect to the from and back walls of the pack. The cigarettes stand respectively to the bottom wall and are thereby offset in height relative to one another. The cigarettes are supported by an upper supporting wall and a lower supporting wall which have recesses aligned with one another for receiving the cigarettes therethrough. The support provided by the supporting walls maintains the cigarettes at a distance from one another and from the walls of the pack.

20 Claims, 10 Drawing Sheets

PACK FOR STICK-SHAPED ARTICLES, SUCH AS CIGARETTES, AND BLANK FOR PRODUCING THE PACK

BACKGROUND OF THE INVENTION

The invention relates to a pack for stick-shaped articles, such as cigarettes or other smoker's articles, especially a hinge-lid pack, with a pack part and with a lid which is connected in an articulated manner to a rear wall of the pack part, the pack part furthermore having a front wall, side walls and a bottom wall, and, in particular, means being provided for arranging a part number of the articles in a position offset in height relative to another part number of the articles.

Hinge-lid packs are a form of pack for cigarettes which is in widespread use throughout the world. In these, a group of cigarettes arranged in rows is surrounded by an inner wrapping made from tin foil or paper. The hinge-lid pack is produced from thin cardboard and has a pack part and a lid. Usually arranged in the pack part is a collar which projects with a part region out of the pack part and which, in the closing position, is surrounded by the lid. To extract the first article more easily, adjacent rows can be arranged offset in height relative to one another.

SUMMARY OF THE INVENTION

The subject of the invention is to propose a novel pack corresponding to the height offset of the articles.

To achieve the object the pack according to the invention is characterized in that a lower edge of the front wall (lower front edge) is arranged offset in height relative to a lower edge of the rear wall (lower rear edge). Respective regions of the bottom wall which are adjacent to one another are therefore likewise automatically offset relative to one another, so that articles standing on the bottom wall in the region of the lower front edge are offset in height relative to the articles near the lower rear edge. As a result, of course, the ends of the articles visible with the lid opened are also offset in height relative to one another, specifically, in particular, a front row relative to a rear row. With further rows, more steps can be obtained correspondingly.

An especially attractive pack design is one in which the lower front edge is offset downwards relative to the lower rear edge. This, with the lid opened, gives the visual impression of rows of articles stepped relative to one another in the manner of stairs. The opposite instance is often advantageous. In that case, the front row of articles is arranged higher than the rear row, so that the very first article can be extracted especially easily.

The bottom wall itself can be designed in various ways. An advantageous solution is one in which the bottom wall for connecting the lower front edge to the lower rear edge is directed obliquely upwards from the front rearwards. This version saves the material and is easy to manufacture.

In another version, the bottom wall for connecting the lower front edge to the lower rear edge is stepped, in particular in the manner of stairs with two bottom planes offset in height relative to one another. According to the number of rows of articles, further steps with further bottom planes can also be made. It is especially advantageous, at the same time, if the individual articles stand on the bottom wall with as large a bearing face as possible. The risk of damage caused by vibrations or the like is largely prevented.

According to a further feature of the invention, it is especially advantageous if there are arranged within the pack part separating members which extend between the articles, in such a way that these are positioned at a distance from one another, in particular one or more transversely directed supporting walls with rows of recesses for the passage of a respective article (in each recess). The rows of articles offset in height relative to one another have an especially attractive effect as a result of the distance provided between them and can be extracted even more simply. Moreover, effects occurring as a result of the contact of the articles with one another, for example friction or the like, can be avoided.

Advantageously, the two transversely directed supporting walls are connected to one another by means of an upright intermediate piece which bears against the rear wall or front wall of the pack part, the supporting walls forming with the intermediate piece a supporting insert and preferably being folded from a common blank. At the same time, a collar arranged in the pack part can adjoin the upper supporting wall in one piece.

With rows of articles terminating at different heights, it is advantageous additionally to fix articles not bearing against the lid or against a lid top wall. According to one feature of the invention, for this purpose, there is arranged in the lid, on the inside, a holding member for loading or holding down at least some of the articles, especially a rear or a front row of articles.

Advantageously, the holding member is connected to a blank part forming the lid, especially in such a way that an inwardly folded lid inner tab and, on the lid inner tab, a tab preferably directed transversely relative to the lid front wall and intended for holding down (holding-down device) adjoin a lid front wall. As a continuation of this idea, the holding-down device can be supported, by a supporting tab directed approximately transversely thereto, against the lid top wall, the supporting tab being connected integrally to the holding-down device and being folded transversely relative to the latter.

The invention is concerned, furthermore, with a blank for forming a pack, .especially the above-described pack according to the invention. Its features and further features essential to the invention can be taken from the claims and from the description.

BRIEF DESCRIPTION OF THE DRAWING

Particular embodiments of the invention are explained in more detail below by means of drawings. In these.

DESCRIPTION OF THE PREFERRED EMBODIMENTS

Figure 1:
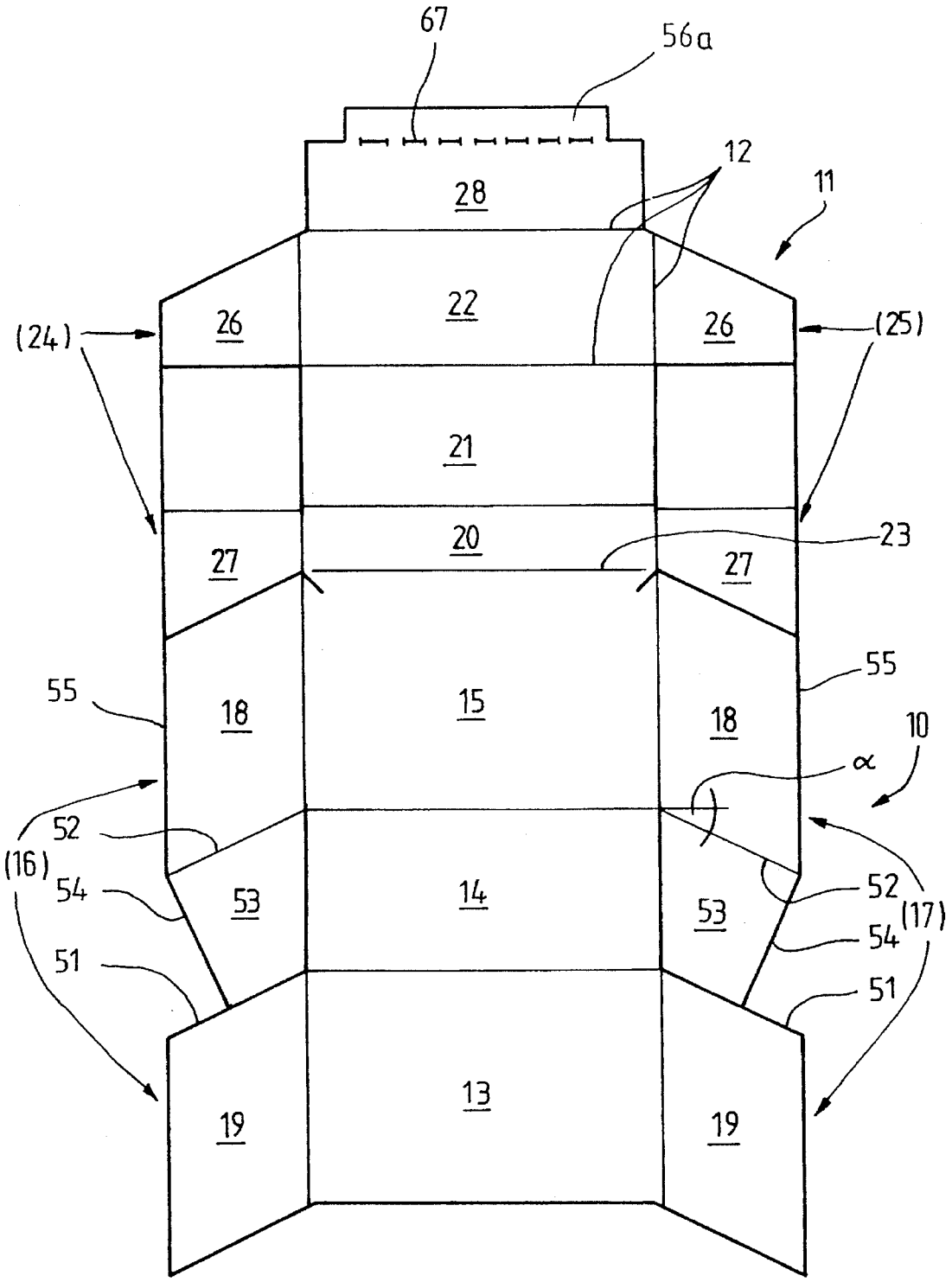
FIG. 1 shows a spread-out blank for a hinge-lid pack.

A preferred exemplary embodiment of a novel blank is shown in FIG. 1. The basic form of a conventional hinge-lid pack with a pack part 10 and a lid 11 is taken as a starting point. Regions are delimited by folding lines 12 to form a front wall 13, a bottom wall 14 and a rear wall 15. Side walls 16 and 17 of the hinge-lid pack each consist of two side tabs 18 and 19 which overlap one another and which are connected to one another by adhesive bonding. The side tabs 18 adjoining the rear wall 15 are located on the inside.

The lid 11 is of a similar design, with a lid rear wall 20, a lid top wall 21 and a lid front wall 22 which adjoin the rear wall 15 of the pack part in this order. A line of articulation 23 for the pivoting movements of the lid 11 during opening and closing is formed between the lid rear wall 20 and rear wall 15. Lid side walls 24 and 25 consist of lid side tabs 26 and 27 in a similar way to the design of the side walls 16, 17. Attached to the free edge of the lid front wall 22 is an inner tab 28 which, in the finished pack, bears against the inside of the lid front wall 22, see FIG. 3, 6*c*, 7*c*, 8*c*.

The hinge-lid pack serves for receiving a group of elongate, stick-shaped articles 29. These can be conventional cigarettes, but also other cigarette-like products. In the present exemplary embodiment, the pack is dimensioned so that 10 articles 29 are positioned upright in two rows 30, 31 (each of five articles) within the hinge-lid pack. The articles 29 are arranged at distances from one another. Identical distances are provided within a row 30, 31. The distances from row to row can have other dimensions.

To maintain the relative positions of the articles 29, each article 29 is supported and held at a distance. In the present exemplary embodiment, two supporting walls, 32, 33 are arranged within the pack part 10. The supporting walls 32, 33 are arranged at a distance from one another in the longitudinal direction of the articles 29 and likewise at a distance from the bottom wall 14 and from the lid 11. The supporting walls 32, 33 extend approximately perpendicularly to the longitudinal direction of the articles 29.

Each supporting wall 32, 33 is provided with a number of recesses 34, 35 corresponding to the number of articles 29. These recesses 34, 35 are positioned according to the relative position of the articles 29, that is to say in rows 30, 31. The recesses 34, 35 of the two supporting walls 32, 33 are positioned coaxially, that is to say coincidentally one above the other, so that each article 29 passes through a recess 34, 35 of one and the other supporting wall 32, 33.

The recesses 34, 35 correspond in form to the outer contour of the article 29. In the present case, with the articles 29 being of cylindrical design, circular recesses 34, 35 are punched in the supporting walls 32, 33. Corresponding punchings are removed completely when the recesses 34, 35 are being made.

Figure 3:
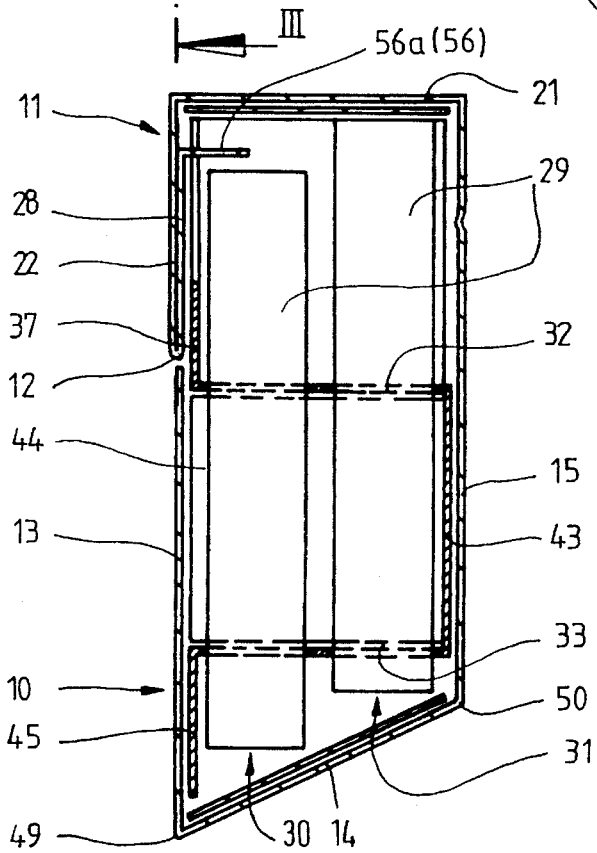
FIG. 3 shows a vertical section through the pack according to FIG. 2 in a sectional plane III—III.
Figure 4:
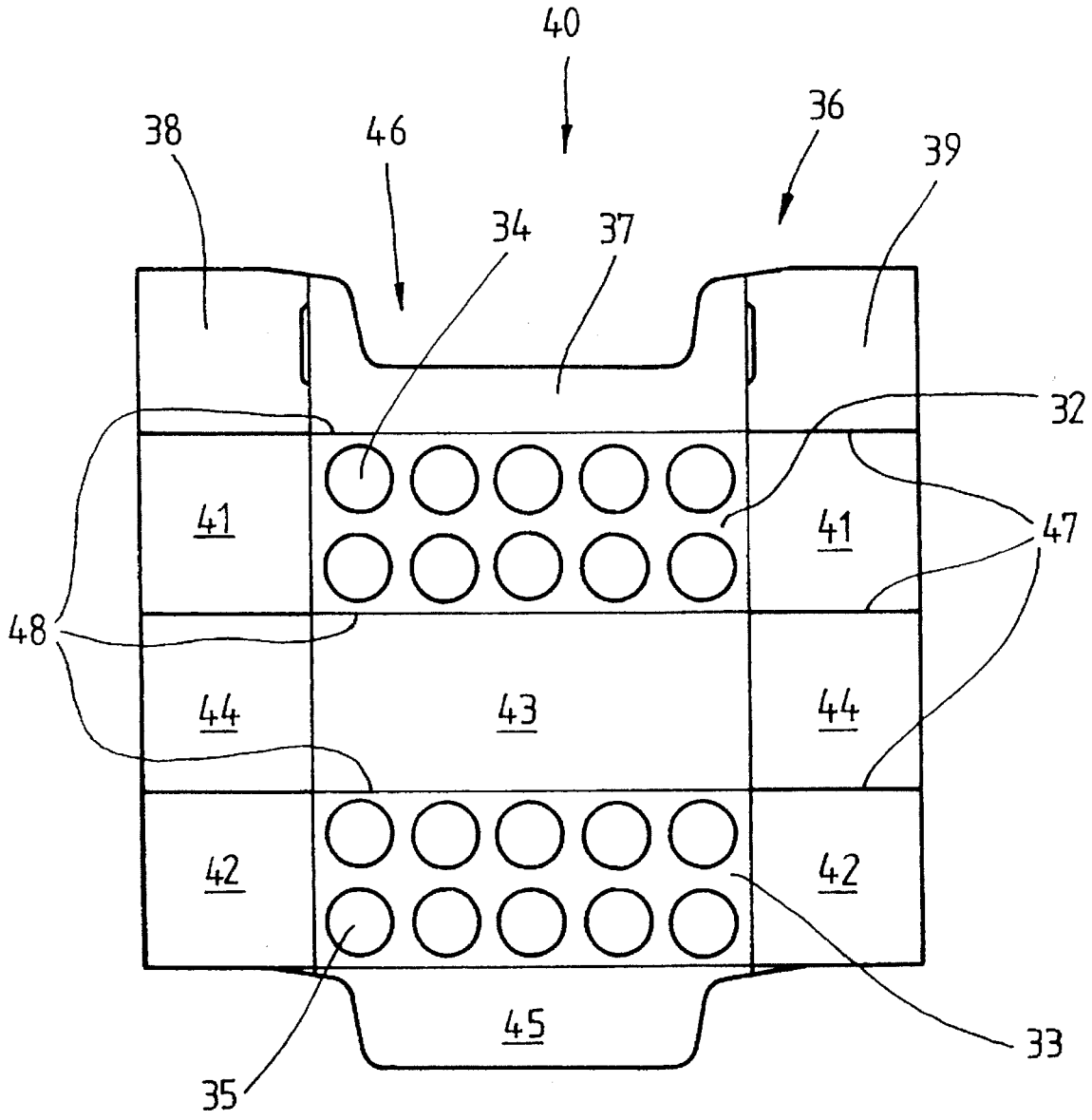
FIG. 4 shows a spread-out blank for a supporting insert.
Figure 5:
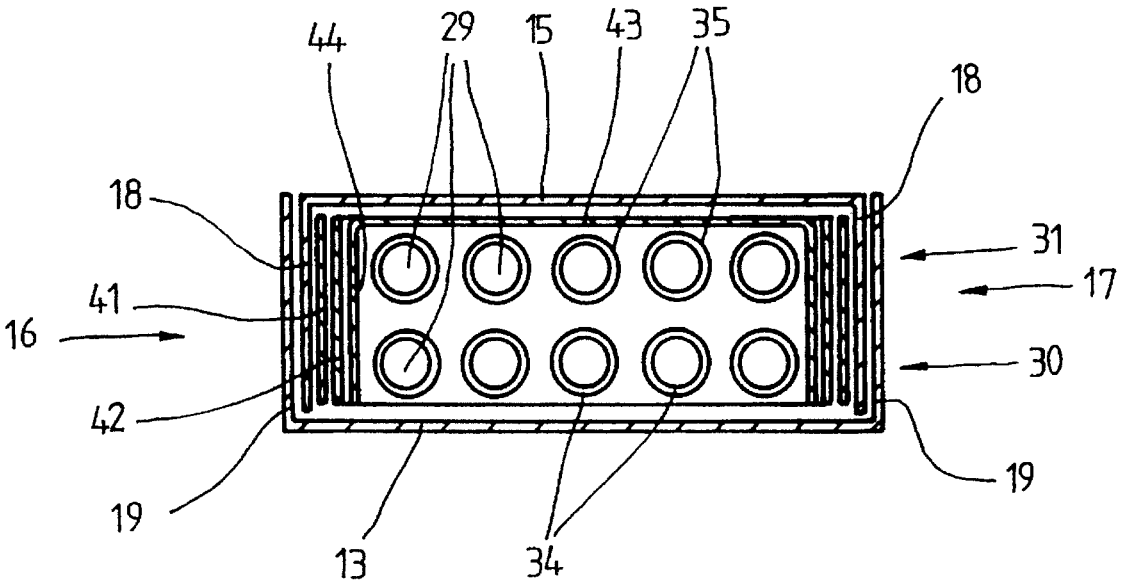
FIG. 5 shows a horizontal section through the pack according to FIG. 2 in the sectional plane V—V.

In the present exemplary embodiment, the supporting walls 32, 33 are connected to one another to form a one-piece blank (FIG. 4). Furthermore, a collar 36 is formed by the same blank. In hinge-lid packs, a collar of this type is customary as an insert in the pack part 10. The collar 36 consists of a collar front wall 37 and collar side tabs 38, 39. The collar front wall 37 bears against the inside of the front wall 13 of the pack part. The collar side tabs 38, 39 extend on the inside in the region of the side walls 16, 17. A part region of the collar 36 projects out of the pack part 10 and, in the closing position, is surrounded by the lid 11 (FIG. 3, 6*c*, 7*c*, 8*c*). The blank according to FIG. 4 is designed in a special way to form a supporting insert 40 within the pack part 10. The width of the blank for this supporting insert 40 corresponds to the necessary width of the collar 36. This results in folding tabs 41 and 42 in the region of the supporting walls 32, 33 on both sides of the latter. The distance between the supporting walls 32, 33 is determined by an intermediate piece 43 of the supporting insert 40, likewise having lateral folding tabs 44.

Furthermore, in the present exemplary embodiment, a spacer tab 45 adjoining the free side of the lower supporting wall 33 is formed in the middle region on the side located opposite the collar 36. The contour of this spacer tab 45 corresponds to the contour of a conventional recess 46 formed in the region of the collar front wall 37. As a result of this overall contour, it is possible to produce the blank for the supporting insert 40 in a manner free of waste by punching from the continuous material web consisting of thin cardboard or the like.

The collar side tabs 38, 39 and the folding tabs 41, 42 and 44 are divided off from one another by means of punching cuts 47.

The supporting insert 40 is shaped three-dimensionally, in such a way that the collar 36 faces the front wall 13 as an upright leg. The upper supporting wall 32 adjoins this by means of transverse folding. There then follows, as an upright folding part, the rectangular intermediate piece 43 which bears against the rear wall 15 of the pack part 10. The lower supporting wall 33 adjoins the lower edge of the intermediate piece 43 by means of transverse folding. The downwardly folded spacer tab 45 is located on the side opposite the intermediate piece 43. The dimensions of the supporting insert 40 are selected such that the spacer tab 45 stands up at the bottom on the bottom wall 14. Parts of the supporting insert 40, especially the collar 36 and/or the intermediate piece 43, can be connected to the parts of the pack facing them by adhesive bonding. The regions of the supporting insert 40 are delimited from one another by parallel folding lines 48.

The pack part 10 is designed in a special way. The bottom wall 14 is directed obliquely relative to the position of a bottom wall in a conventionally cuboid pack. The bottom wall 14 extends from a lower edge 49 of the front wall 13 obliquely upwards as far as a lower edge 50 of the rear wall 15. The angle of inclination amounts to approximately 25°. The obliquity results in a front row 30 located somewhat lower than the rear row 31 of articles 29. With the pack opened, a visually attractive pattern is obtained thereby. In particular, the extraction of the articles 29 is simplified by the stepped arrangement of these.

To form the oblique bottom wall 14, the blank for the pack part 10 is designed in a special way. The side tabs 19 are of rhombic design with bevelled bottom edges 51. "Bottom edges", because these edges bear against the bottom wall 14 in the finished pack.

In a similar way, lower edges 52 of the side tabs 18 are directed obliquely, specifically parallel to the bottom edges 51. Here too, the angle of inclination amounts to approximately 25°.

Bottom corner tabs 53 adjacent to the bottom wall 14 and adjoining the side tabs 18 downwards are designed in a special way. Their outer edge 54 extends in a continuation of an outer edge 55 of the side tabs 18, but bevelled (inwards) relative to this, with an angle of inclination which is at least as large as the angle of inclination α of 25° previously mentioned. In the present exemplary embodiment, the outer edge 54 extends perpendicularly to the lower edge 52.

A special feature is afforded in the region of the lid 11. In FIG. 1, a tab 56*a* parallel to the inner tab 28 adjoins the latter outwards to form a holding-down device 56. Its function is shown in more detail in FIG. 3. The holding-down device 56 is folded approximately perpendicularly to the inner tab 28 and secures the front row 30 of articles 29 against movements in their longitudinal direction. As a result of the inclination of the bottom wall 14, the rear row 31 bears on the lid 11 at the top.

The holding-down device 56 is made narrower than the recess 46 in the collar 36. "Narrow" means in the direction from the lid side wall 24 to the lid side wall 25. Contact with the collar front wall 37 is thereby avoided.

Figure 6A:
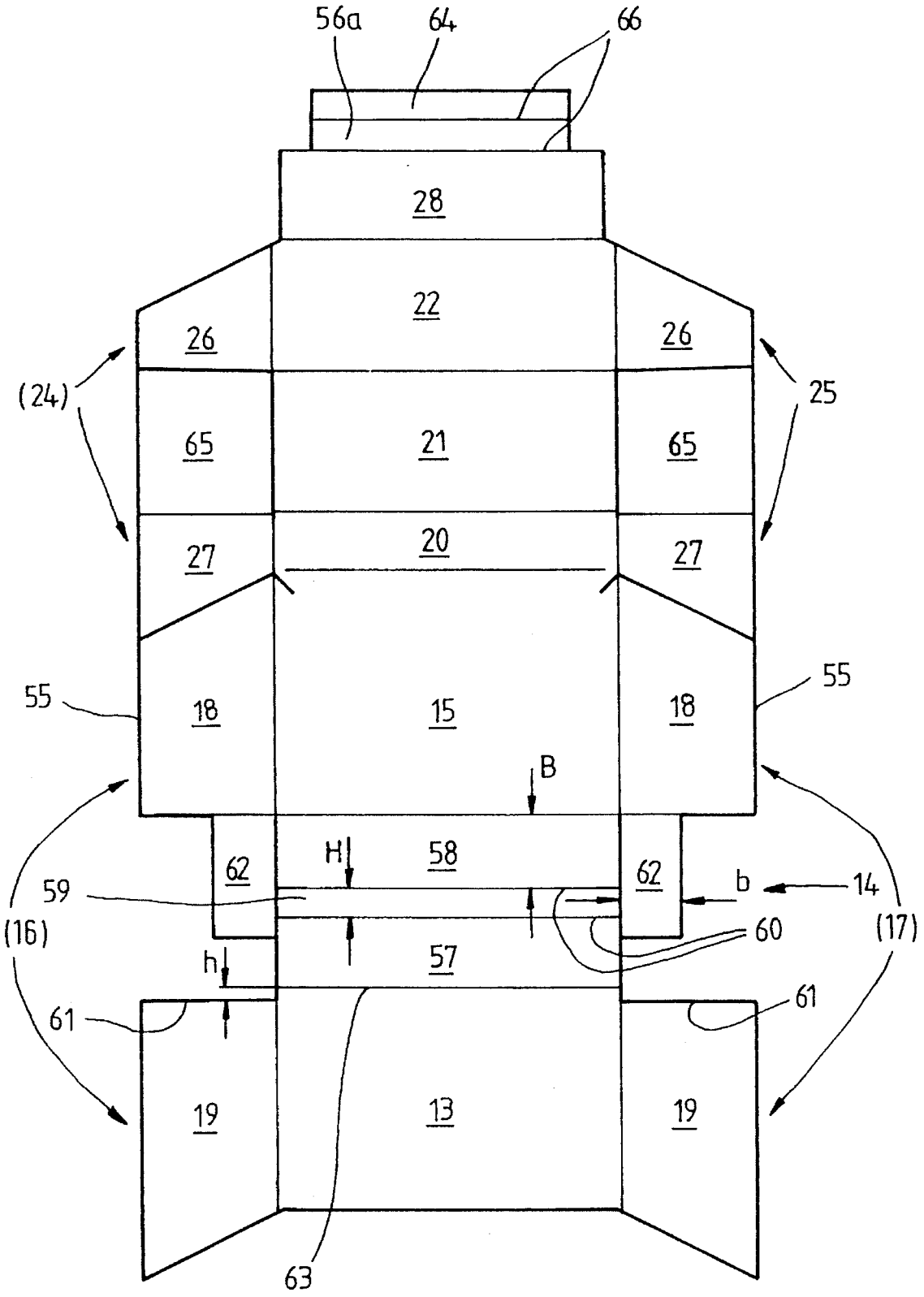
FIG. 6*a* shows a spread-out blank for another embodiment of a hinge-lid pack.
Figure 6B:
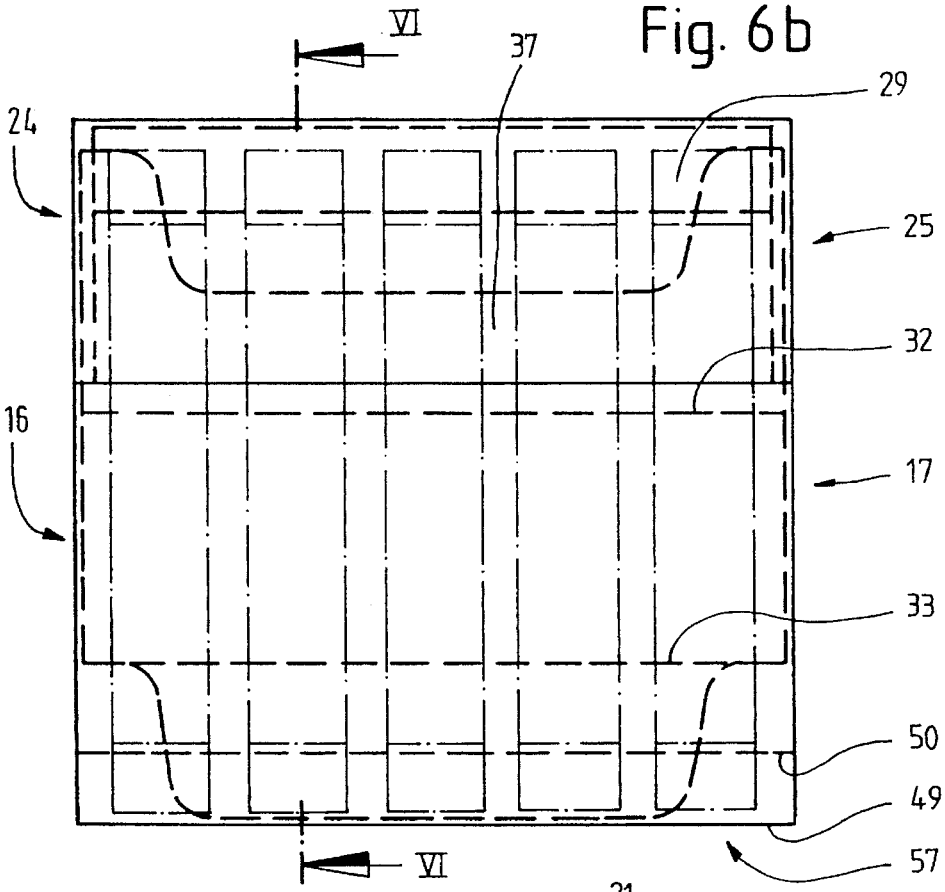
FIG. 6*b* shows a finished closed pack, corresponding to the blank according to FIG. 6*a*, in a front view.
Figure 6C:
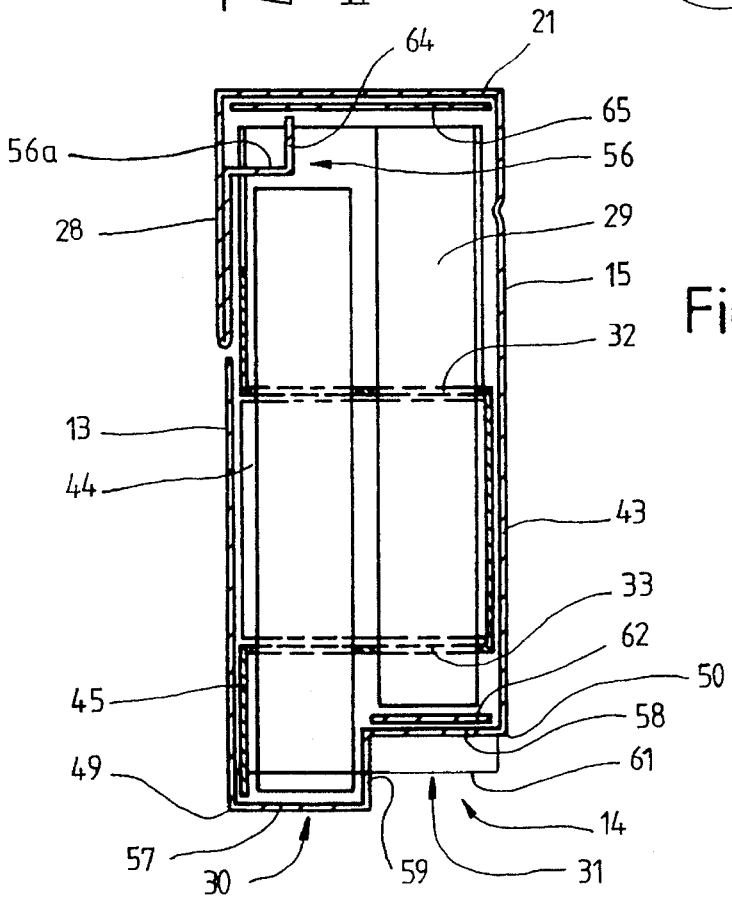
FIG. 6*c* shows a vertical section through the pack according to FIG. 6*b* in a sectional plane VI—VI.

FIGS. 6*a*, 6*b* and 6*c* show modifications of the embodiment described hitherto. They relate, on the one hand, to a different design of the bottom wall 14 and, on the other hand, to a development of the lid 11 in the region of the holding-down device 56. As far as possible, the same reference numerals as before are used in FIGS. 6*a*, 6*b* and 6*c*.

According to FIG. 6*a*, the bottom wall 14 is made in three parts, with a front bottom plane 57 adjoining the front wall 13, with a rear bottom plane 58 adjoining the rear wall 15 and with an intermediate piece 59 connecting the two planes 57, 58. The three planes are delimited from one another by folding lines 60. Bottom edges 61 limiting the side tabs 19 extend in the direction approximately perpendicular to the outer edge 55 or to the main direction of extension of the blank shown in FIG. 6*a*. Accordingly, in this embodiment, no bevelled bottom is obtained, but instead a bottom wall 14 stepped in the manner of stairs, see FIG. 6*c*. As is evident in FIG. 3, in the present embodiment a height offset of the front row 30 of articles 29 relative to the rear row 31 is obtained. The front row 30 is once again located lower.

To fold the stair-shaped bottom wall 14, bottom corner tabs 62 adjoining the side tabs 18 downwards in FIG. 6*a* and having a width b corresponding at most to the width B of the rear bottom plane 58 are formed. The bottom corner tabs 62 are approximately rectangular and, in the ready-folded pack, come to rest on the rear bottom plane 58, see FIG. 6*c*.

A special feature as regards the length and arrangement of the side tabs 19 is also afforded in this respect. These are arranged offset relative to a folding line 63 between the front bottom plane 57 and front wall 13 downwards in FIG. 6—towards the lid in the finished pack. The height offset h of the folding line 63 relative to the bottom edges 61 is equal to half the width (height H) of the intermediate plane 59, h=½ H. In the finished pack according to FIG. 6*c*, a downward projection of the bottom edges 61 is thereby obtained in relation to the rear bottom plane 58. At the same time, the bottom edge 61 does not quite reach down as far as the front bottom plane 57. This is especially advantageous when two packs are combined respectively to form a small composite package, not shown. The packs bear respectively with their stair-shaped bottom walls 14 against one another, so that the bottom plane 58 of one pack bears on the bottom plane 57 of the other pack, and vice versa. The particular part of the side tab 19 of one pack which projects beyond the rear bottom plane 58 then covers the region of the other particular pack not covered by the side tab 19 in the region of the front bottom plane 57.

Figure 2:
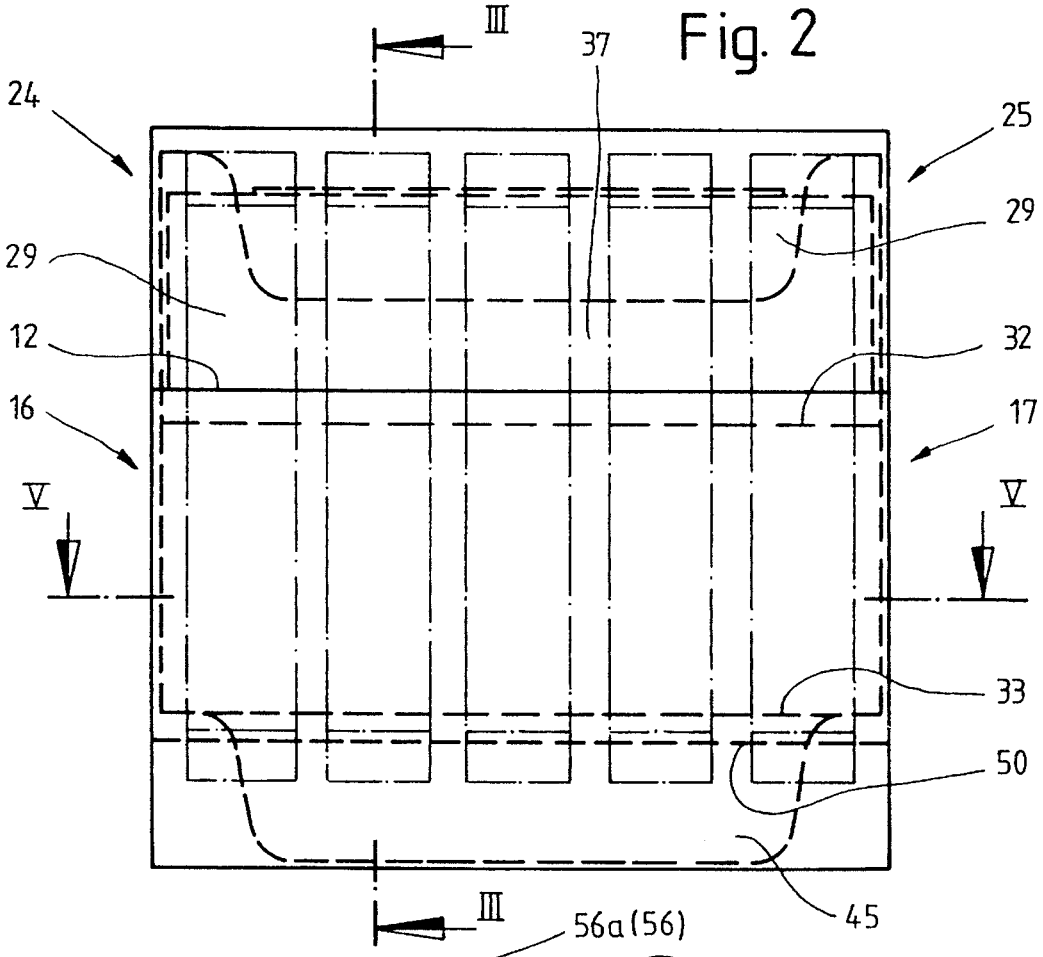
FIG. 2 shows a finished closed pack in a front view.

A further difference from FIGS. 1 to 3 is provided in the region of the holding-down device 56. In FIGS. 6*a*, 6*b* and 6*c*, a supporting tab 64 adjoins the tab 56*a* as a supporting member. This supporting tab 64 is transversely folded relative to the tab 56*a* and therefore extends in a plane parallel to the inner tab 28. The supporting tab 64 is supported against the lid top wall 21 or against lid corner tabs 65 bearing on the lid top wall 21. The shape and dimensions of the supporting tab 64 correspond approximately to the tab 56*a*. The width of the supporting tab 64, that is to say the distance between the tab 56*a* and the lid top wall 21, corresponds approximately to the height offset of the two rows 30, 31. The supporting tab 64 causes the articles 29 of the front row 30 to be secured even better against movements in their longitudinal direction.

Folding lines 66 are provided between the tab 56*a* and the supporting tab 64 or the inner tab 28. Instead, an interrupted punching line 67 is shown in FIG. 1.

Figure 7A:
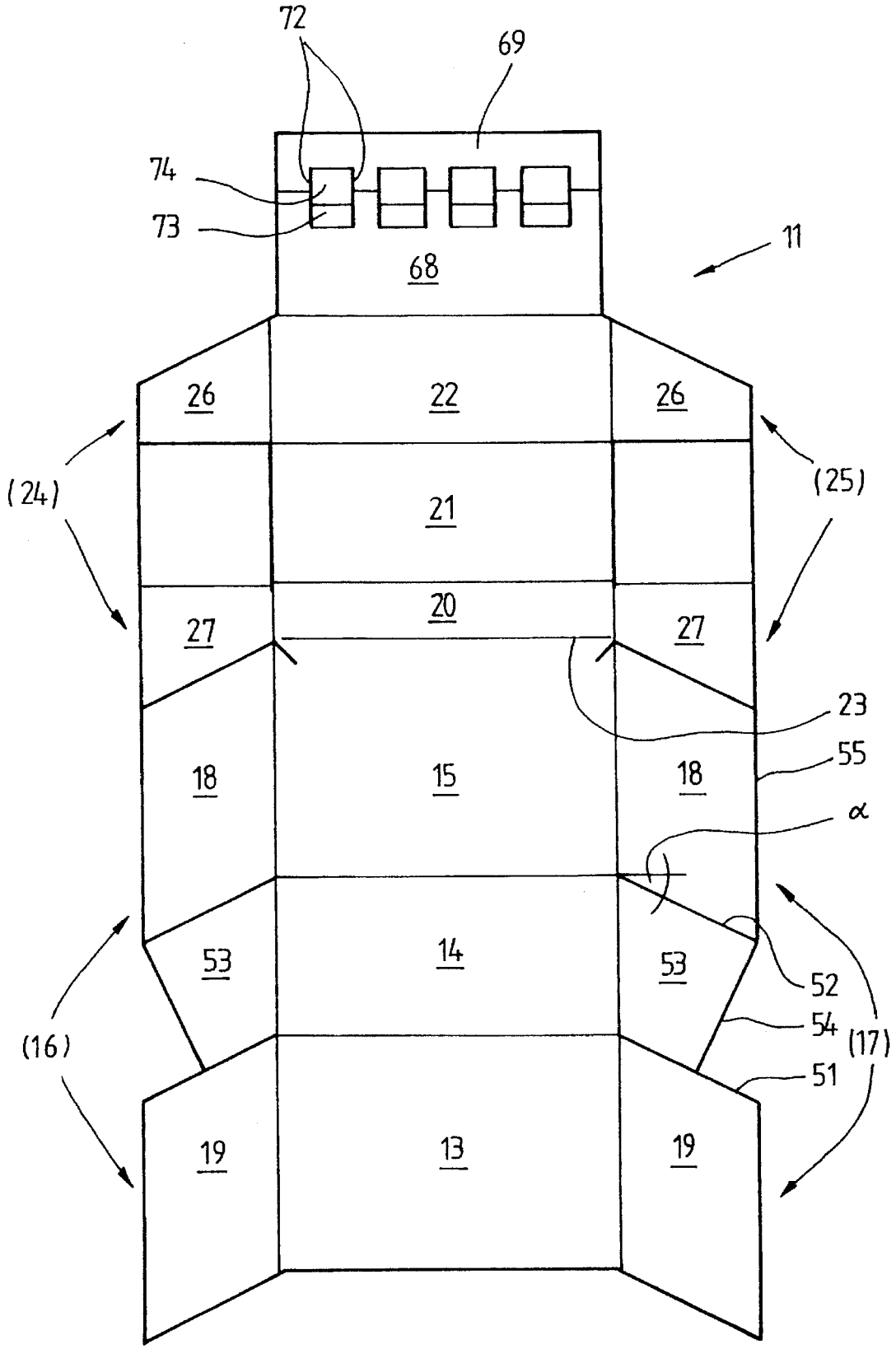
FIG. 7*a* shows a spread-out blank for a further embodiment of a hinge-lid pack.
Figure 7B:
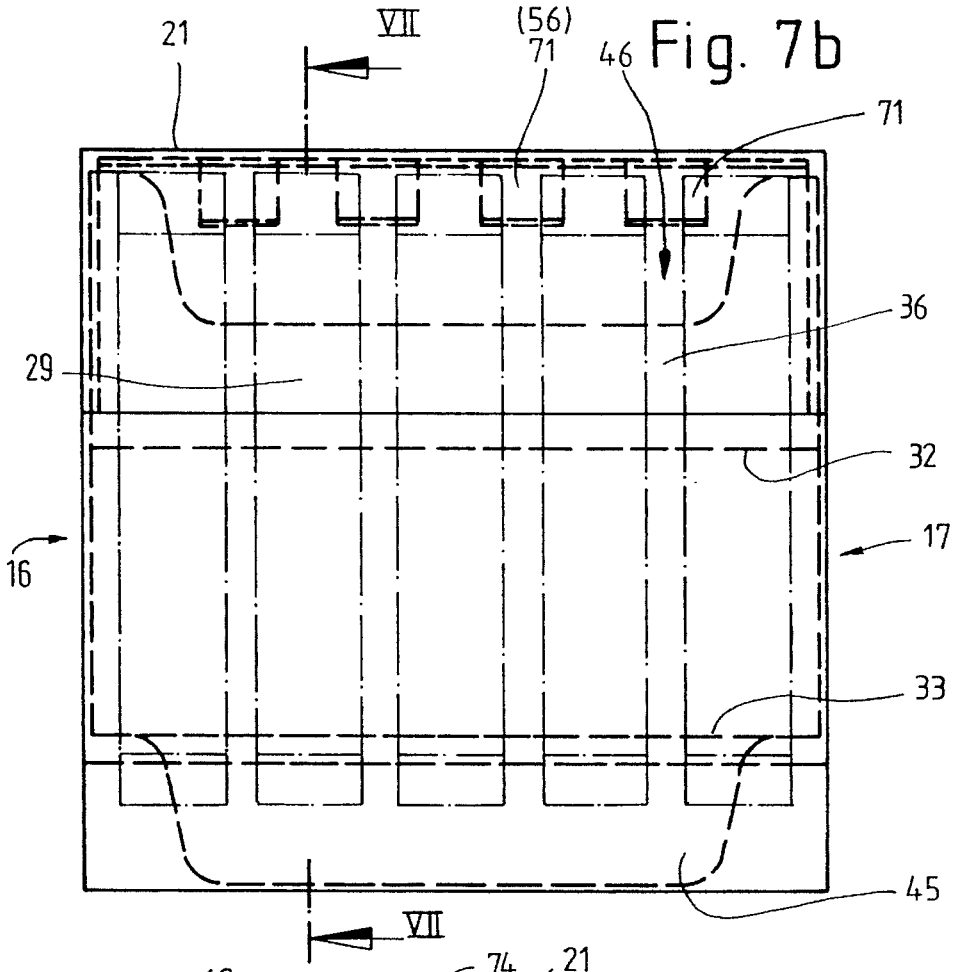
FIG. 7*b* shows a finished closed pack, corresponding to the blank according to FIG. 7*a*, in a front view.
Figure 7C:
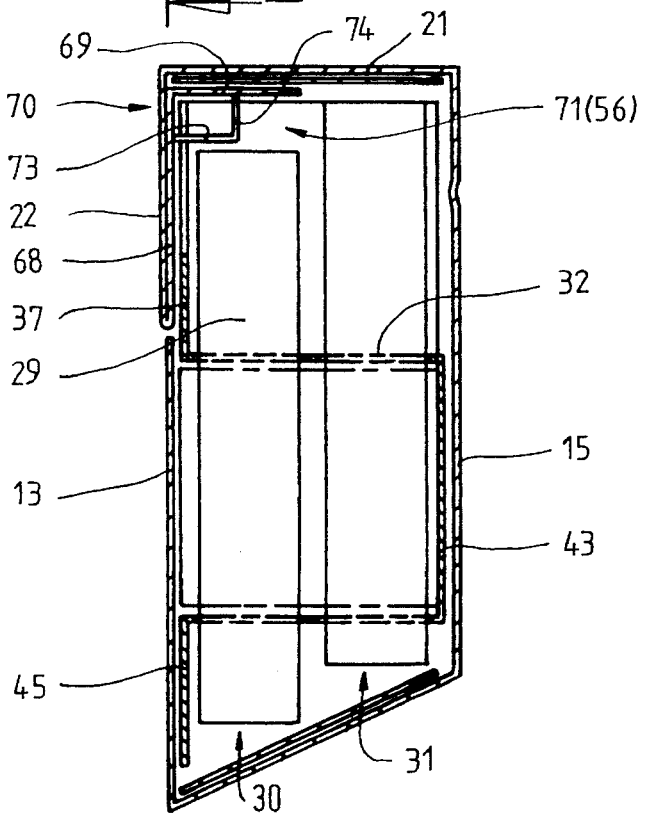
FIG. 7*c* shows a vertical section through the pack according to FIG. 7*b* in a sectional plane VII—VII.

FIGS. 7*a*, 7*b* and 7*c* show a pack consisting of a blank modified in relation to FIG. 1. The modification is in the region of the lid 11 or in the region adjoining the lid front wall 22. Inasmuch as there is identity with FIGS. 1 to 3, the same reference numerals are given. According to FIG. 7*a*, an inner tab 68 adjoins the lid front wall 22 upwards. This inner tab 68 is longer than the inner tab 28 according to FIG. 1 and, according to FIG. 7*c*, extends almost as far as the lid top wall 21. A tab extension 69 adjoins the inner tab 68 and has the same width as the latter. In the ready-folded pack, the tab extension 69 is parallel to the lid top wall 21 and therefore angled relative to the inner tab 68. A plurality of heels 71 are provided next to one another in the direction from side wall to side wall in the angle 70 between the inner tab 68 and tab extension 69. These heels 71 perform the function of the holding-down device 56, in a similar way to the tab 56*a* according to FIG. 3 and FIG. 6*c*. The heels are formed by two respective severing cuts parallel to one another and are folded out of the angle 70 by means of a fold in the opposite direction to the latter. Two legs 73, 74 are thus obtained for each heel 71. The former starts from the inner tab 68 and is angled relative to this. The second leg 74 starts from the tab extension 69 and is angled relative to the latter and to the leg 73. According to FIG. 7*b*, if there are five articles 29 in a row 30, altogether four heels 71 are arranged. The latter are staggered and each act against two respective adjacent articles as holding-down devices. By means of this staggered arrangement, the heels 71 are inevitably offset inwards from the side walls. The possibility of obstruction by the collar 36 is thus prevented. On the contrary, the heels 71 are located in the region of the collar recess 46. The length of the leg 73 extends approximately to half the diameter of the articles of the front row 30. The length of the leg 74 corresponds approximately to the height offset of the two rows 30, 31.

Figure 8A:
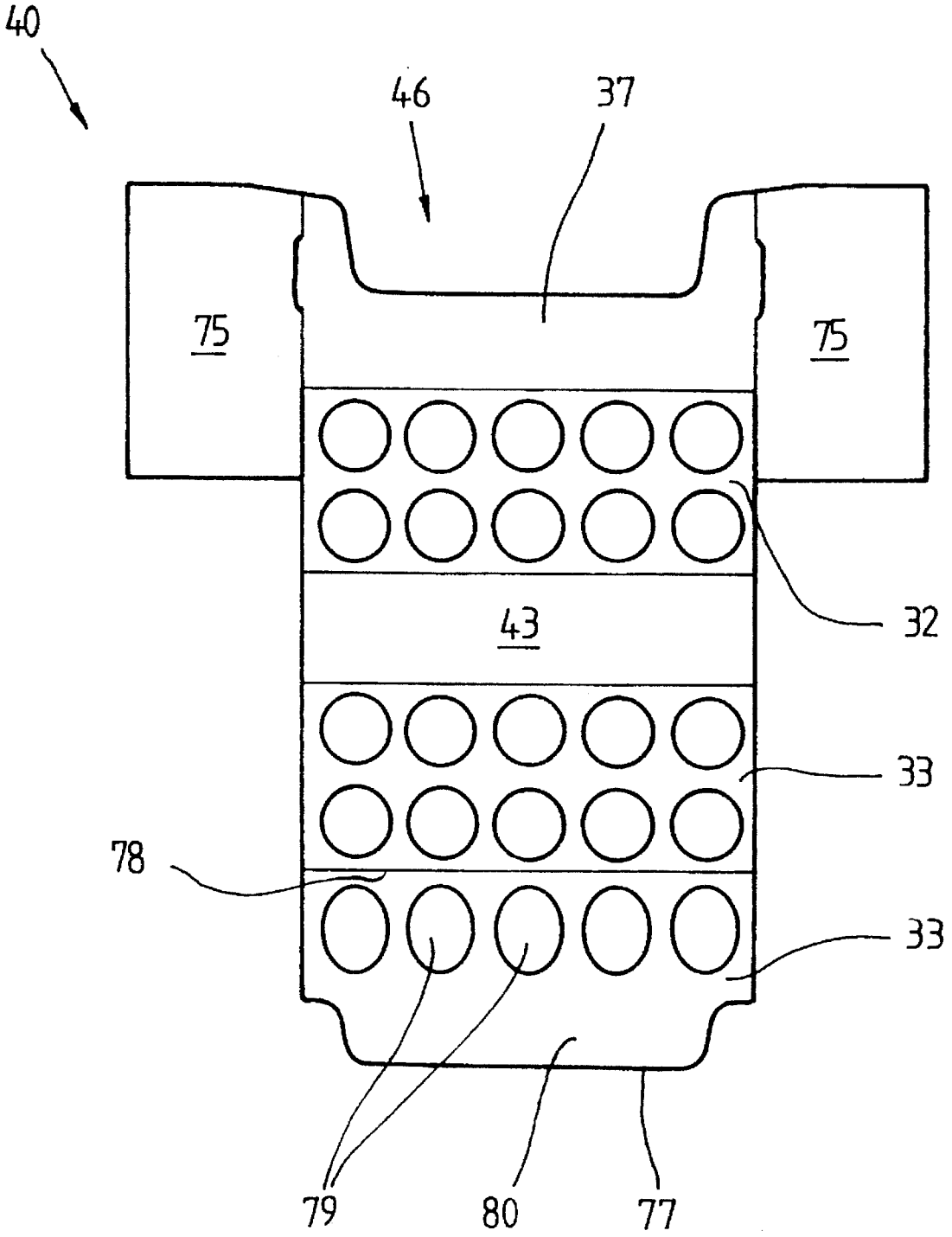
FIG. 8*a* shows a spread-out blank for another embodiment of a supporting insert.
Figure 8B:
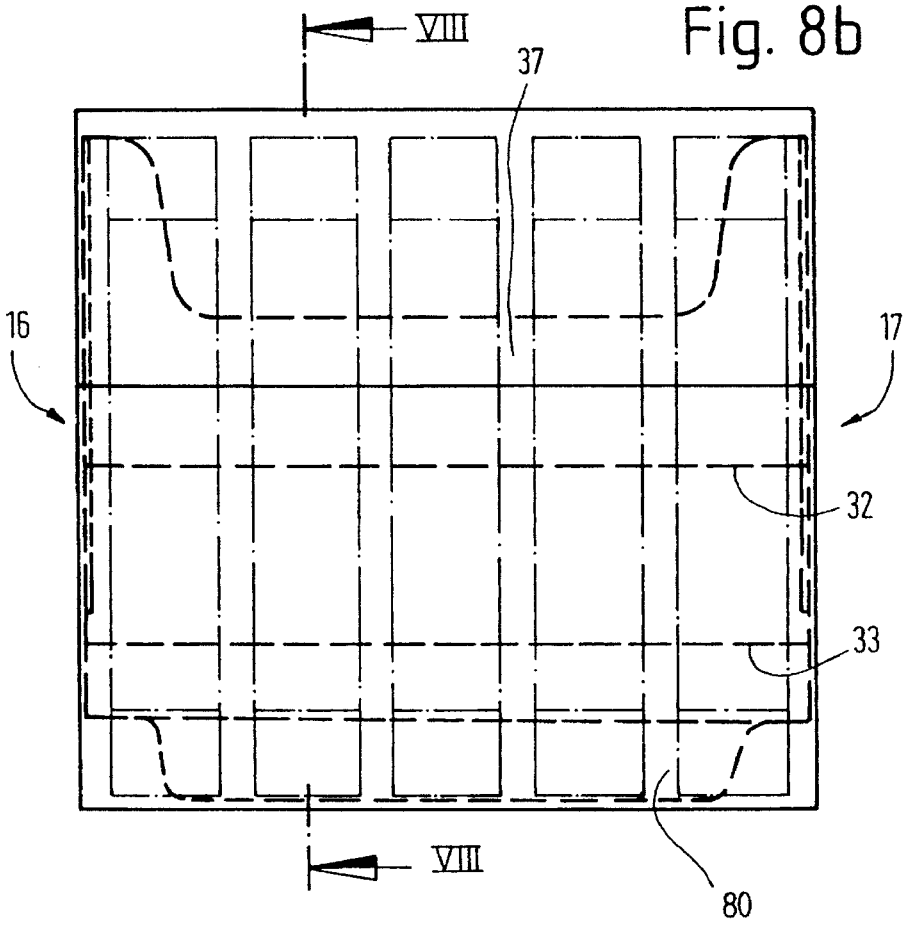
FIG. 8*b* shows a finished closed pack, with a supporting insert according to FIG. 8*a*, in a front view.
Figure 8C:
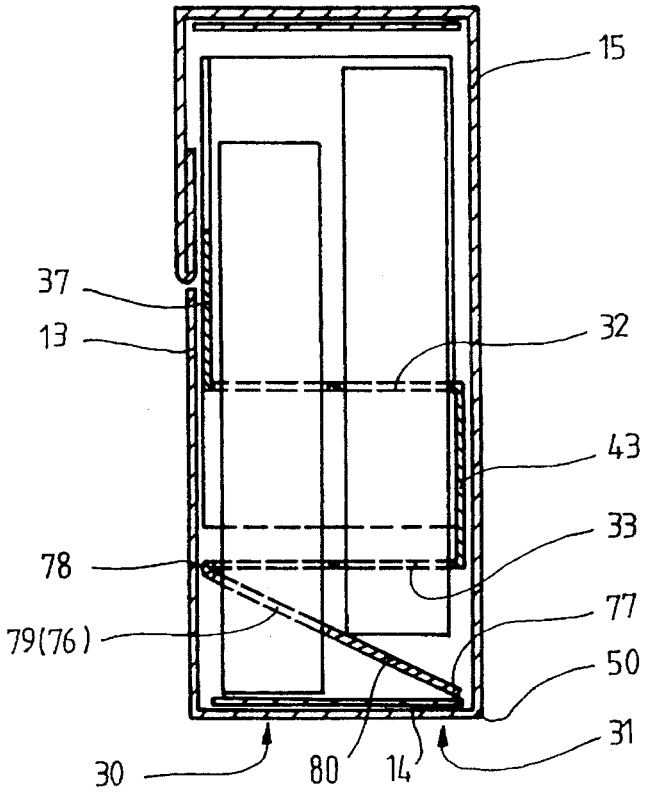
FIG. 8*c* shows a vertical section through the pack according to FIG. 8*b* in a sectional plane VIII—VIII.

FIGS. 8*a*, 8*b* and 8*c* illustrate a further embodiment of the pack according to the invention. The pack, that is to say the pack part 10 with lid 11, is of cuboid design here in the conventional way, that is to say without an inclined bottom (FIG. 3) or a stepped bottom (FIG. 6*c*). Nevertheless, here too, means by which a part number of articles in the pack is arranged offset in height relative to another part number are provided. For this purpose, the supporting insert 40 is designed in a special way. A middle region with a collar front wall 37, supporting wall 32, intermediate piece 43 and supporting wall 33 corresponds to the embodiment according to FIG. 4—in FIG. 8*a*, the intermediate piece 43 is somewhat shorter, so that the supporting walls 32, 33 are at a shorter distance from one another in the finished pack. Instead of the individual tabs 38, 39, 41, 42, 44, a collar side tab 75 is provided on each of the two sides of the collar front wall 37 in FIG. 8*a*. This collar side tab 75 is respectively articulated laterally on the collar front wall 37 and, at the same time, is extended downwards, that is to say in the direction of the intermediate piece 43, approximately up to half of the upper supporting wall 32.

A further supporting wall 76 adjoining the lower supporting wall 33 is provided here as a special feature. This supporting wall 76 is somewhat longer than each of the supporting walls 32, 33, so that it does not fit transversely into the pack, but on the contrary is arranged obliquely (FIG. 8*c*). A lower edge 77 of the supporting wall 76 is located near the lower rear edge 50 on the pack bottom (bottom wall 14). An upper edge 78, which is parallel thereto and which at the same time marks a folding line between the supporting wall 33 and the lowest supporting wall 76, bears on the front wall 13 with a height offset relative to the lower rear edge 50.

Only one row of recesses 79 is provided in the supporting wall 76. These are shaped elliptically, so that the articles of the front row 30 are held virtually free of play in the recesses 79. A region 80 of the supporting wall 76 located in the region of the rear row 31 in the finished pack has no recesses. The articles of the rear row 31 are supported on this region 80 or bear on the latter. This results automatically in a height offset of the rear row 31 supported on the region 80 relative to the front articles of the front row 30 which project through the recesses 79. The region 80 is made somewhat narrower than the rest of the supporting wall 76 for easier introduction into the pack.

According to an embodiment not shown the oblique supporting wall 76 is part of a collar blank, without further intermediate supporting walls.

No holding members for holding down the respective lower row of articles are shown in FIGS. 8*b* and 8*c*. Nevertheless, these can be present according to the embodiments described. Also, the embodiments for the height offset of the articles can be combined in any way with the embodiments in respect of the holding members.

What is claimed is:

1. A hinge lid-pack for stick-shaped articles (29), comprising:

a pack part (10) having a front wall (13), side walls (16, 17), a rear wall (15) and a bottom wall (14), said bottom wall (14) being connected to the from wall (13) and rear wall (15) in one piece; and a lid (11) having a lid from wall (22), lid side walls (24, 25), a lid top wall (21) and a lid rear wall (20), said lid rear wall (20) being connected to the rear wall (15) in an articulated manner;

wherein, the front wall (13) has a lower from edge (49) adjoining the bottom wall (14), and the rear wall has a lower rear edge (50) adjoining the bottom wall (14), and wherein the bottom wall (14), from the front wall (13) towards the rear wall (15), is directed obliquely so that the front edge (49) is offset relative to the rear edge (50);

said pack further comprising a supporting insert arranged inside of the pack part (10), said insert having:

an upper supporting wall (32) and a lower supporting wall (33) which are connected to one another by an intermediate piece (43), and which extend transversely relative to the longitudinal direction of the articles (29);

wherein recesses (34,35) are formed in each of said supporting walls (32, 33), said recesses (34, 35) arranged at distances from one another for the passage of one article (29) each, so that the articles (29) are held at a distance from one another in the pack part (10).

2. Pack as claimed in claim 1, wherein said recesses (34, 35) are formed as holes in the supporting walls (32, 30), and the articles (29) are also held in the pack part (10) at a distance from the front wall (13), rear wall (15), and the side walls (16, 17).

3. Pack as claimed in claim 1, further comprising a collar (36) which is unitarily formed with said upper supporting wall, and which has a lower region which bears against the inside of the front wall (13) and an upper region which projects from the front wall (13).

4. Pack as claimed in claim 1, wherein the recesses (34) in the upper supporting wall (32) are arranged in alignment with the recesses (35) in the lower supporting wall (33).

5. A hinge-lid pack for stick-shaped articles (29), comprising:

a pack part (10) having a front wall (13), side walls (16, 17), a rear wall (15) and a bottom wall (14), said bottom wall (14) being connected to the front wall (13) and rear wall (15) in one piece; and a lid (11) having a lid from wall (22), lid side walls (24, 25), a lid top wall (21) and a lid rear wall (20), said lid rear wall (20) being connected to the rear wall (15) in an articulated manner;

wherein, the from wall (13) has a lower from edge (49) adjoining the bottom wall (14), and the rear wall has a lower rear edge (50) adjoining the bottom wall (14), and wherein the bottom wall (14), from the front wall (13) towards the rear wall (15), is directed obliquely so that the front edge (49) is offset relative to the rear edge (50);

said pack further comprising: a holding member arranged inside of said lid for exerting pressure on at least a front row (30) of articles (29), with pressure directed towards the bottom wall (14); and an inwardly folded lid inner wall (28) adjoining the lid front wall (22), the holding member being connected to the lid inner wall (28) at a distance from the lid top wall (21).

6. A hinge-lid pack for stick-shaped articles (29) comprising:

a pack part (10) having a from wall (13), side walls (16, 17), a rear wall (15) and a bottom wall (14), said bottom wall (14) being connected to the front wall (13) and rear wall (15) in one piece; and a lid (11) having a lid front wall (22), lid side walls (24, 25), a lid top wall (21) and a lid rear wall (20), said lid rear wall (20) being connected to the rear wall (15) in an articulated manner;

wherein, the front wall (13) has a lower from edge (49) adjoining the bottom wall (14), and the rear wall has a lower rear edge (50) adjoining the bottom wall (14), wherein the bottom wall (14), from the front wall (13) towards the rear wall (15), is directed obliquely so that the front edge (49) is offset relative to the rear edge (50); and wherein the articles (29) are arranged in two rows in the pack, as a front row (30) and a rear row (31), and wherein the from row (30), because of the oblique bottom wall (14), is downwardly offset relative to the rear row (31).

7. A hinge-lid pack for stick-shaped articles (29), comprising:

a pack part (10) having a from wall (13), side walls (16, 17), a rear wall (15) and a bottom wall (14);

a lid (11) with a lid from wall (22), lid side walls (24, 25), a lid top wall (21) and a lid rear wall (20), said lid rear wall (20) being connected to the rear wall (15) in an articulated manner; and an upper supporting wall (32) and a lower supporting wall (33), which are connected to one another and which extend transversely to the longitudinal direction of the articles (29); and wherein recesses (34,35) are formed in each of said supporting walls (32, 33), said recesses (34, 35) arranged at distances from one another for the passage of one article (29) each, so that the articles (29) are held at a distance from one another in the pack (10).

8. Pack as claimed in claim 7, wherein said recesses (34, 35) are formed as holes in the supporting walls (32, 33), and the articles (29) are also held in the pack part (10) at a distance from the front wall (13), rear wall (15), and the side walls (16, 17).

9. Pack as claimed in claim 7, further comprising:

an intermediate piece (43) connected between said upper and lower supporting walls and which extends parallel to the rear wall (15) and bears against the rear wall (15); and a collar (36) which is unitarily formed with said upper supporting wall, and which has a lower region which bears against the inside of the front wall (13) and an upper region which projects from the front wall (13).

10. Pack as claimed in claim 7, wherein the recesses (34) in the upper supporting wall (32) are arranged in alignment with the recesses (35) in the lower supporting wall (33).

11. Pack as claimed in claim 7, further comprising:

a holding member arranged inside of said lid for exerting pressure on at least a front wall (30) of articles (29), with pressure directed towards the bottom wall (14); and an inwardly folded lid inner wall (28) adjoining the lid front wall (22), and the holding member being connected to the inner tab (28) at a distance from the lid top wall (21).

12. Pack as claimed in claim 7, wherein the articles (29) in the pack are arranged in two rows, specifically in a front row (30) adjacent to the front wall (13), and a rear row (31) adjacent to the rear wall (15).

13. A hinge-lid pack for cigarette-like articles (29), comprising;

a pack part (10) having a from wall (13), side walls (16, 17), a rear wall (15) and a bottom wall (14) which is articulated to the rear wall (15); and a lid (11) having a lid from wall (22), lid side walls (24, 25) a lid top wall (21) and a lid rear wall (20), said lid rear wall (20) being connected to the rear wall (15) in an articulated manner; and a holding member arranged inside of the lid (11), at a distance from the lid top wall (21), said holding member for exerting pressure on at least a part of the articles (29), in the direction of the bottom wall (14);

wherein said holding member is connected to a blank part forming the lid (11), such that said lid front wall (22) is adjoined by an inner tab (28), which is folded inwardly into the inside of the lid, and which bears against the lid front wall (22); and wherein the holding member is connected to the inner tab (28);

wherein the inner tab (28) which bears against the inside of the lid from wall (22), is adjoined at a distance from the lid top wall (21) by a transversely directed tab (**56*a*) which is directed perpendicular to the lid front wall (22**) as the holding member;

said pack further comprising an upwardly directed supporting tab (64) which adjoins the transversely directed tab (**56*a*) and bears against the lid top wall (21**).

14. A hinge-lid pack for cigarette-like articles (29), comprising:

a pack part (10) having a front wall (13), side walls (16, 17), a rear wall (15) and a bottom wall (14) which is articulated to the rear wall (15); and a lid (11) having a lid front wall (22), lid side walls (24, 25) a lid top wall (21) and a lid rear wall (20), said lid rear wall (20) being connected to the rear wall (15) in an articulated manner; and a holding member arranged inside of the lid (11), at a distance from the lid top wall (21), said holding member for exerting pressure on at least a part of the articles (29), in the direction of the bottom wall (14);

wherein said holding member is connected to a blank part forming the lid (11), such that said lid front wall (22) is adjoined by an inner tab (28), which is folded inwardly into the inside of the lid, and which bears against the lid front wall (22); and wherein the holding member is connected to the inner tab (28); and wherein said inner tab (68) which bears against the inside of the lid front wall (22), is adjoined by a tab extension (69), which bears against the lid top wall (21), and which is directed transversely to the inner tab (68), and in that at least one heel (71) with legs (73, 74) directed transversely against one another is provided as a holding-down device between inner tab (68) and tab extension (69), and in that each heel (71) is formed by two parallel severing cuts and a folding in the opposite direction of the angle (70) between inner tab (68) and tab extension (69).

15. A blank for forming a hinge-lid pack for stick-shaped articles (29), said pack having a pack part (10) and a lid (11) which is connected in an articulated manner to a rear wall (15) of the pack part (10), the pack part (10) having a front wall (13), side walls (16, 17), a bottom wall (14), and means for arranging a first row (30) of the articles (29) in a position offset in height relative to another row (31) of the articles (29), wherein a lower edge (49) of the front wall (13) is arranged offset in height relative to a lower edge (50) of the rear wall (15), said blank comprising:

regions delimited by folding lines, for forming the from wall (13), the bottom wall (14), the rear wall (15), the side walls (16, 17), also a lid rear wall (20), a lid top wall (21), a lid front wall (22) and lid side tabs (26, 27), wherein adjoining the side walls (18, 19) are bottom corner tabs (53) which, in the pack, lie in one plane with the bottom wall (14), wherein free lateral edges (54) of the bottom corner tabs (53) are made bevelled in relation to the blank, to form an oblique bottom wall (14), and wherein lower edges (51, 52), of the side walls (18, 19) are made bevelled in such a way that the lateral edges (54) and the lower edges (51, 52) are perpendicular to one another.

16. A hinge-lid pack for stick-shaped articles (29), comprising:

a pack part (10) having a front wall (13), side walls (16, 17), a rear wall (15) and a bottom wall (14), said bottom wall (14) being connected to the front wall (13) and rear wall (15) in one piece; and a lid (11) having a lid from wall (22), lid side walls (24, 25), a lid top wall (21) and a lid rear wall (20), said lid rear wall (20) being connected to the rear wall (15) in an articulated maimer wherein, the from wall (13) has a lower from edge (49) adjoining the bottom wall (14), and the rear wall has a lower rear edge (50) adjoining the bottom wall (14), wherein the bottom wall (14), from the front wall (13) towards the rear wall (15), is directed obliquely so that the front edge (49) is offset relative to the rear edge (50), and wherein the bottom wall (14) for connecting the lower front edge (49) to the lower rear edge (50) is stepped in the manner of stairs with two bottom planes (57, 58) offset in height relative to one another.

17. A hinge-lid pack for stick-shaped articles (29), comprising:

a pack part (10) having a from wall (13), side walls (16, 17), a rear wall (15) and a bottom wall (14), said bottom wall (14) being connected to the from wall (13) and rear wall (15) in one piece; and a lid (11) having a lid from wall (22), lid side walls (24, 25), a lid top wall (21) and a lid rear wall (20), said lid rear wall (20) being connected to the rear wall (15) in an articulated manner;

wherein, the from wall (13) has a lower from edge (49) adjoining the bottom wall (14), and the rear wall has a lower rear edge (50) adjoining the bottom wall (14), wherein the bottom wall (14), from the from wall (13) towards the rear wall (15), is directed obliquely so that the from edge (49) is offset relative to the rear edge (50), and wherein horizontal lower edges (61) of the side walls (19) are arranged offset in height relative to the lower from edge (49) and the lower rear edge (50) approximately at mid-height between the front edge (49) and the rear edge (50).

18. A hinge-lid pack for stick-shaped articles (29), comprising a pack part (10) and a lid (11) which is connected in an articulated manner to a rear wall (15) of the pack part (10), the pack part (10) furthermore having a from wall (13), side walls (16, 17) and a bottom wall (14), wherein a separating member, comprising a supporting wall (76) with recesses (79) for some of the articles, is arranged obliquely within the pack part (10), in such a way that one row (30) of articles (29) is positioned in the recesses (79) and another row (31) stands offset in height, relative to said one row, on a portion (80) of the supporting wall (76).

19. Blank for forming a pack, according to claim 7, said blank having regions delimited by folding lines, for forming the front wall (13), bottom wall (14), rear wall (15), side walls (16, 17), also the lid rear wall (20), lid top wall (21), lid front wall (22) and lid side tabs (26, 27), there adjoining the side walls (18 or 19) bottom corner tabs (53) which, in the finished pack, lie in one plane with the bottom wall (14), wherein, to form two planes offset in height relative to one another, the bottom wall (14) is divided in three by two parallel folding lines (60) into a rear bottom plane (58), an intermediate piece (59) and a front bottom plane (57).

20. Blank for forming a supporting insert (40), for use in a pack according to claim 18, with one or more supporting walls which each have recesses (34, 35, 79) for the passage of articles (29), one of said supporting walls (76) having recesses (79) in a part region only and having no recesses suitable for the passage of the articles (29) in an outer free end region (80).

* * * * *